US010369837B2

(12) United States Patent
Ryberg et al.

(10) Patent No.: US 10,369,837 B2
(45) Date of Patent: Aug. 6, 2019

(54) METHOD FOR FORMING A DECORATIVE DESIGN ON AN ELEMENT OF A WOOD-BASED MATERIAL

(71) Applicant: VALINGE INNOVATION AB, Viken (SE)

(72) Inventors: Melker Ryberg, Malmo (SE); Jan Jacobsson, Landskrona (SE)

(73) Assignee: VALINGE INNOVATION AB, Viken (SE)

( * ) Notice: Subject to any disclaimer, the term of this patent is extended or adjusted under 35 U.S.C. 154(b) by 921 days.

(21) Appl. No.: 13/873,773

(22) Filed: Apr. 30, 2013

(65) Prior Publication Data

US 2013/0286088 A1 Oct. 31, 2013

Related U.S. Application Data

(60) Provisional application No. 61/640,513, filed on Apr. 30, 2012.

(51) Int. Cl.

| | |
|---|---|
| ***B41M 5/00*** | (2006.01) |
| ***B44D 5/00*** | (2006.01) |
| ***B44F 9/00*** | (2006.01) |
| ***B44C 5/04*** | (2006.01) |
| ***B44F 9/02*** | (2006.01) |
| *E04F 15/04* | (2006.01) |

(52) U.S. Cl.

CPC ..... *B44D 5/00* (2013.01); *B41M 5/0017* (2013.01); *B41M 5/0047* (2013.01); *B41M 5/0076* (2013.01); *B44C 5/043* (2013.01); *B44F 9/00* (2013.01); *B44F 9/02* (2013.01); *E04F 15/04* (2013.01); *Y10T 428/24802* (2015.01)

(58) Field of Classification Search

CPC .. B44C 5/043; B44F 9/02; B44F 9/00; B41M 5/0076; B41M 5/0017; B41M 5/0047; B44D 5/00; E04F 15/04

USPC ..... 347/105, 9, 21; 522/25; 428/195, 143

See application file for complete search history.

(56) References Cited

U.S. PATENT DOCUMENTS

| | | | |
|---|---|---|---|
| 3,210,302 | A | 10/1965 | Bowell |
| 5,141,599 | A | 8/1992 | Jahn et al. |
| 5,486,231 | A | 1/1996 | Dulaney |
| 5,989,701 | A | 11/1999 | Goetzen |

(Continued)

FOREIGN PATENT DOCUMENTS

| | | | |
|---|---|---|---|
| CN | 101885200 | * | 11/2010 |
| CN | 102781677 | A | 11/2012 |

(Continued)

OTHER PUBLICATIONS

U.S. Appl. No. 14/237,617, Pervan.

(Continued)

*Primary Examiner* — Scott A Richmond

(74) *Attorney, Agent, or Firm* — Buchanan Ingersoll & Rooney P.C.

(57) ABSTRACT

A method for forming a decorative design (2) on an element (1) of a wood-based material, including providing an element (1) of a wood-based material having a surface (3), the surface (3) being solid and being formed of the wood-based material, and printing a decorative design (2) with an aqueous ink on at least a portion of the surface (3) by means of a digital printing device. Also, a building element including such an element.

9 Claims, 3 Drawing Sheets

(56) References Cited

U.S. PATENT DOCUMENTS

| | | | | |
|---|---|---|---|---|
| 6,087,416 | A | 7/2000 | Pearlstine et al. | |
| 6,310,115 | B1 * | 10/2001 | Vanmaele et al. | 522/25 |
| 6,565,919 | B1 | 5/2003 | Hansson | |
| 6,585,369 | B1 * | 7/2003 | Sievert et al. | 347/105 |
| 6,800,340 | B1 | 10/2004 | Francescutti | |
| 9,605,168 | B2 | 3/2017 | Pervan | |
| 9,994,010 | B2 | 6/2018 | Pervan | |
| 2002/0061389 | A1 * | 5/2002 | Brooker | B41M 5/0047 428/32.18 |
| 2003/0207083 | A1 * | 11/2003 | Hansson et al. | 428/143 |
| 2004/0061753 | A1 | 4/2004 | Chen | |
| 2004/0191547 | A1 | 9/2004 | Oldorff | |
| 2004/0250911 | A1 | 12/2004 | Vogel | |
| 2005/0193677 | A1 | 9/2005 | Vogel | |
| 2005/0249929 | A1 | 11/2005 | Reichwein et al. | |
| 2007/0058018 | A1 | 3/2007 | Ishibashi | |
| 2007/0193174 | A1 * | 8/2007 | Vogel | B44C 1/24 52/483.1 |
| 2007/0224438 | A1 | 9/2007 | Van Benthem et al. | |
| 2007/0283648 | A1 | 12/2007 | Chen | |
| 2008/0048388 | A1 | 2/2008 | Gauss et al. | |
| 2008/0152825 | A1 | 6/2008 | Mukai et al. | |
| 2008/0152877 | A1 | 6/2008 | Mukai | |
| 2008/0176039 | A1 | 7/2008 | Chen et al. | |
| 2008/0252709 | A1 | 10/2008 | Ushiku | |
| 2009/0031662 | A1 | 2/2009 | Chen | |
| 2010/0091058 | A1 * | 4/2010 | Hale et al. | 347/9 |
| 2010/0196678 | A1 | 8/2010 | Vermeulen | |
| 2010/0300030 | A1 | 12/2010 | Pervan et al. | |
| 2010/0307675 | A1 | 12/2010 | Buhlmann | |
| 2010/0323187 | A1 | 12/2010 | Kalwa | |
| 2011/0012954 | A1 | 1/2011 | Brown et al. | |
| 2011/0135815 | A1 * | 6/2011 | Ganapathiappan | C09D 11/328 427/160 |
| 2011/0151148 | A1 * | 6/2011 | Koenig | B41M 5/5218 428/32.18 |
| 2011/0177354 | A1 | 7/2011 | Ziegler et al. | |
| 2011/0180202 | A1 | 7/2011 | Hirst et al. | |
| 2011/0189448 | A1 | 8/2011 | Lindgren et al. | |
| 2011/0234727 | A1 | 9/2011 | Aoki et al. | |
| 2011/0247748 | A1 | 10/2011 | Pervan et al. | |
| 2011/0250404 | A1 | 10/2011 | Pervan et al. | |
| 2011/0303113 | A1 * | 12/2011 | Sarkisian | B41M 5/0017 101/491 |
| 2012/0015107 | A1 | 1/2012 | Schacht et al. | |
| 2012/0113193 | A1 | 5/2012 | Yamashita | |
| 2012/0147108 | A1 | 6/2012 | Ganapathiappan et al. | |
| 2012/0169808 | A1 | 7/2012 | Kiyomoto et al. | |
| 2012/0178844 | A1 * | 7/2012 | Frey | C07C 217/36 522/8 |
| 2012/0249705 | A1 | 10/2012 | Aoki et al. | |
| 2012/0288689 | A1 | 11/2012 | Hansson et al. | |
| 2013/0063528 | A1 | 3/2013 | Govyadinov | |
| 2013/0286088 | A1 | 10/2013 | Jacobsson | |
| 2014/0017452 | A1 | 1/2014 | Pervan | |
| 2014/0028772 | A1 | 1/2014 | Pervan | |
| 2014/0144583 | A1 | 5/2014 | Hakansson et al. | |
| 2014/0186610 | A1 | 7/2014 | Pervan | |
| 2014/0198168 | A1 | 7/2014 | Pervan et al. | |
| 2015/0210055 | A1 | 7/2015 | Pervan | |
| 2015/0218395 | A1 | 8/2015 | Pervan | |
| 2016/0250835 | A1 | 9/2016 | Pervan | |
| 2018/0319148 | A1 | 11/2018 | Pervan | |

FOREIGN PATENT DOCUMENTS

| | | | |
|---|---|---|---|
| DE | 10 2010 045 266 | A | 3/2012 |
| EP | 1 328 407 | | 5/2002 |
| EP | 1 242 702 | A1 | 9/2002 |
| EP | 1 314 766 | A1 | 5/2003 |
| EP | 1 403 343 | A1 | 3/2004 |
| EP | 1 454 763 | A2 | 9/2004 |
| EP | 1 242 702 | B1 | 11/2004 |
| EP | 1 577 354 | A2 | 9/2005 |
| EP | 1 577 354 | A3 | 9/2005 |
| EP | 1 584 378 | A1 | 10/2005 |
| EP | 1 328 407 | B1 | 8/2008 |
| EP | 1 980 598 | A1 | 10/2008 |
| EP | 1 454 763 | B1 | 8/2009 |
| EP | 2 202 056 | A1 | 6/2010 |
| EP | 2 213 476 | A1 | 8/2010 |
| EP | 2 264 259 | A2 | 12/2010 |
| EP | 2 313 281 | A1 | 4/2011 |
| EP | 2 313 281 | B1 | 7/2012 |
| JP | 2006-281538 | A | 10/2006 |
| JP | 2008-265229 | A | 11/2008 |
| WO | WO 01/19618 | A1 | 3/2001 |
| WO | WO 01/47717 | A1 | 7/2001 |
| WO | WO 01/48333 | A1 | 7/2001 |
| WO | WO 01/53387 | A1 | 7/2001 |
| WO | WO 02/42087 | A2 | 5/2002 |
| WO | WO 02/42087 | A3 | 5/2002 |
| WO | WO 2004/042168 | A1 | 5/2004 |
| WO | WO 2005/097874 | A2 | 10/2005 |
| WO | WO 2006/001880 | A2 | 1/2006 |
| WO | WO 2006/106931 | A1 | 10/2006 |
| WO | WO 2007/015669 | A2 | 2/2007 |
| WO | WO 2009/018260 | A1 | 2/2009 |
| WO | WO 2009/065769 | A2 | 5/2009 |
| WO | WO 2009/065769 | A3 | 5/2009 |
| WO | WO 2009/080813 | A1 | 7/2009 |
| WO | WO 2009/097986 | A1 | 8/2009 |
| WO | WO 2009/124704 | A1 | 10/2009 |
| WO | WO 2010/084386 | A2 | 7/2010 |
| WO | WO 2010/084386 | A3 | 7/2010 |
| WO | WO 2011/020755 | A1 | 2/2011 |
| WO | WO 2011/087422 | A1 | 7/2011 |
| WO | WO 2011/087423 | A1 | 7/2011 |
| WO | WO 2011/105613 | A1 | 9/2011 |
| WO | WO2011103641 | * | 9/2011 |
| WO | WO 2011/141849 | A2 | 11/2011 |
| WO | WO 2011/141849 | A3 | 11/2011 |
| WO | WO 2011/146149 | A1 | 11/2011 |
| WO | WO 2012/004701 | A2 | 1/2012 |
| WO | WO 2013/032387 | A1 | 3/2013 |
| WO | WO 2014/011110 | A1 | 1/2014 |
| WO | WO 2014/027179 | A1 | 2/2014 |
| WO | WO 2014/084787 | A1 | 6/2014 |

OTHER PUBLICATIONS

Pervan, Darko, U.S. Appl. No. 14/237,617, entitled "Panel Coating," filed Feb. 7, 2014.

Hakansson, Niclas, et al., U.S. Appl. No. 61/730,699 entitled "Method of Producing a Floor Panel," filed Nov. 28, 2012.

International-Type Search Report issued in Swedish National Application No. 1250432-0, International-Type Search Request No. ITS/SE12/00106, dated Nov. 7, 2012, ISA/SE, Stockholm, SE, 5 pages.

International Search Report issued in PCT/SE2013/050477, dated Aug. 27, 2013, ISA/SE, Stockholm, SE, 5 pages.

Hakansson, Niclas, et al., U.S. Appl. No. 14/091,957 entitled "Method of Producing a Floor Panel," filed Nov. 27, 2013.

Pervan, Darko, U.S. Appl. No. 14/602,581 entitled "Digital Print with Water-Based Ink on Panel Surfaces," filed Jan. 22, 2015.

Pervan, Darko, U.S. Appl. No. 14/610,256 entitled "Digital Print With Water-Based Ink," filed Jan. 30, 2015.

Extended European Search Report issued in EP 13 784 946.9, dated Dec. 23, 2015, European Patent Office, Munich, DE, 9 pages.

Pervan, Darko, et al., Technical Disclosure entitled Digital Printing and Embossing, IP.com No. IPCOM000224950D, IP.com PriorArtDatabase, Jan. 15, 2013, 89 pages.

Pervan, Darko, Technical Disclosure entitled "Digital Overlay," IP.com No. IPCOM000225271D, IP.com PriorArtDatabase, Feb. 5, 2013, 24 pages.

Pervan, Darko, U.S. Appl. No. 15/028,873 entitled "Method of Forming a Decorative Wear Resistant Layer," filed Apr. 12, 2016.

Pervan, Darko, U.S. Appl. No. 15/428,582 entitled "Digital Print With Water-Based Ink," filed Feb. 9, 2017.

Pervan, Darko, U.S. Appl. No. 16/103,124 entitled "Digital Print with Water-Based Ink," filed Aug. 14, 2018.

(56) References Cited

OTHER PUBLICATIONS

Ryberg, Melker, U.S. Appl. No. 16/085,277 entitled "A Method for Forming a Décor on a Substrate," filed Sep. 14, 2018.
Pervan, Darko, U.S. Appl. No. 15/980,056 entitled "Digital Print with Water-Based Ink on Panel Surfaces," filed May 15, 2018.

* cited by examiner

METHOD FOR FORMING A DECORATIVE DESIGN ON AN ELEMENT OF A WOOD-BASED MATERIAL

CROSS REFERENCE TO RELATED APPLICATIONS

The present application claims the benefit of U.S. Provisional Application No. 61/640,513 filed on Apr. 30, 2012. The entire contents of U.S. Provisional Application No. 61/640,513 are hereby incorporated herein by reference in their entirety.

TECHNICAL FIELD

The present disclosure relates to a method for forming a decorative design on an element of wood-based material by printing the decorative design.

TECHNICAL BACKGROUND

In recent years, digital printing has offered new possibilities in the flooring industry to customize decorative patterns for flooring applications.

Instead of printing large quantities of decor paper with a decorative pattern by rotogravure or direct printing, digital printing offers a possibility to print small quantities of decor paper. Thereby, the digital printing technique offers a possibility to create a large number of different patterns and to customize patterns.

Digital printing has been used to form decorative patterns for laminate floorings but also on wooden floorings in order to form a fantasy pattern on the surface or to print a natural wood pattern.

By digital printing is conventionally meant printing by means of non-contact printing, for example using a Drop-on-Demand (DOD) technique. A drop of ink is placed with great accuracy on a paper or wood surface. Examples of DOD techniques are piezoelectric DOD inkjet and thermal DOD inkjet. In a piezoelectric DOD inkjet printer, the piezoelectric material changes shape when a voltage is applied. The change of shape of the piezoelectric material generates a pressure pulse in the fluid, thereby ejecting a droplet of ink from the nozzle. In a thermal DOD inkjet printer, ink drops are ejected by forming an ink vapour bubble by heating the ink.

When printing on a wooden surface, a UV curable ink is conventionally used. The UV curable ink comprises a UV curable polymer. The UV curable ink is applied on the wooden surface by means of digital printing. The ink is exposed to strong UV light such that the UV curable polymer cures. Thereby, by curing the polymer, the ink is no longer wet after the printing process and can therefore no longer come off.

An advantage of UV curable inks is that it may be applied to a wide range of substrates without any need for coating the substrate before printing due to the ink is cured directly after printing. This property is especially advantageous when printing on a wooden surface. The UV curable ink is cured before any bleeding of the ink into the wood has occurred.

However, UV curable inks are expensive compared to another types of inks. Furthermore, UV curable inks are generally not environmentally friendly, mainly due to the UV curable polymers included in the ink. Special consideration has to be taken during curing in order to avoid exposure to vapours formed by curing and also to avoid exposure to UV radiation originating from the UV lamp used for curing. Before being cured, UV curable inks may be extremely irritating to eyes and skin. Since UV curable inks do not dry without being cured, it remains wet until being cured. Consequently, the risk of skin irritation remains until the UV curable ink has been washed off. If a person is exposed to UV curable inks or vapours originating from UV inks during a long time, the exposure may cause sensitization, i.e. that even low level exposure may lead to a violent reaction.

SUMMARY

It is an object of certain embodiments of the present disclosure to provide an alternative or improvement over the above described techniques and known art.

A further object of at least certain embodiments is to provide a method for forming a design on an element of a wood-based material, which is less hazardous for a person controlling the process.

A further object of at least certain embodiments is to provide a method for forming a decorative design on an element of a wood-based material, which is less expensive compared to prior art solutions.

At least some of these and other objects and advantages that will be apparent from the description have been achieved by a method for forming a decorative design on an element of a wood-based material, comprising providing an element of a wood-based material having a surface, said surface being solid and being formed of said wood-based material, and printing a decorative design with an aqueous ink on at least a portion of said surface by means of a digital printing device.

Preferably, a primer adapted to control bleeding of said ink is applied on at least a portion of said surface. Preferably, the primer is an ink fixing primer.

By a method according to an embodiment of the present disclosure, it is possible to create advanced designs on a surface in a less expensive way compared to known solutions. It is for example possible to create a design having a natural wood-like design being very close to natural wood or a stone-like design. By printing similar designs on several elements, the elements will belong to the same quality rating and undesired variations in the design can be prevented. By slightly varying the design, variations resembling natural variation of the design can be obtained.

In addition to natural designs, decorative designs not resembling natural designs such as fantasy patterns may also be achieved. Such decorative designs may include design elements, adding colour to the surface, printing letters and symbols etc. The design elements may form a repetitive pattern or may be individual design elements.

By printing a decorative design on a less expensive wood material, such as birch or beech wood, the decorative design may resemble the natural pattern of a more expensive sort of wood. However, a method according to an embodiment of the present disclosure may be used on any kind of wood material, also to print a decorative design such as a logotype on a more expensive kind of wood material.

To summarize, by a decorative design is meant any element contributing to the visual impression of the element. By decorative design is also meant objects being non-repetitive.

By digital printing the decorative design, variations in the design of the decorative design can easily be achieved at a low cost. Compared to offset printing or rotogravure printing, no costs are involved in manufacturing a printing plate or a gravure cylinder. Thereby, a large amount of different designs can be printed. The designs can be individualised at low cost and can be printed on demand.

An advantage of using an aqueous ink, also called water-based ink, is that an aqueous ink is less expensive compared to UV curable inks and solvent inks. Further, disadvantages associated with UV curable inks such as being irritating to skin and eyes are overcome by using an aqueous ink instead. An aqueous ink is less irritating to skin and eyes and no UV lamp is required for curing of the ink. Thereby, the use of aqueous inks contributes to an improved working environment.

By applying a primer, bleeding of the ink can be controlled and/or reduced. Thereby, the disadvantages usually associated with use of an aqueous ink such as bleeding can be overcome. By applying a primer prior to printing, the aqueous ink acts similarly as a UV curable ink. By using a primer, the ink drops are fixed at the position on the surface where the ink drops are placed by the nozzle, or at least the undesired bleeding of the aqueous ink is reduced.

Using an aqueous ink may be an advantage when printing natural patterns, since the capillaries in the wood-based material convey the ink and the ink bleeds such that a soft and natural pattern is obtained on portions of the element where it is desired.

The element may be an upper part or layer of a building panel, wherein the upper part or layer forms the surface of the building panel. The decorative design may be printed on a building panel wherein the element forms a surface layer of wood-based material, the surface being solid. The decorative design may also be printed on an element, which in a later process is to be attached to for example a core or substrate to form a building panel. The element itself may also form a building panel.

The primer may comprise at least one metallic salt. The metallic salt precipitates the pigment of the ink composition. The metallic salt reacts with the aqueous ink such that the pigment of the ink precipitates. The metallic salt of the primer crashes the ink such that the pigment of the ink precipitates or agglomerates. By crashing the aqueous pigmented ink, the ink drops are fixed at the position on the surface where the ink drops are placed by the nozzle. By crashing the aqueous pigment ink, the ink drops are prevented from being mixed with each other.

Alternatively, the primer may be a UV curable primer. The UV curable primer reduces displacement of the ink drops on the surface such that bleeding of the ink is reduced. The ink drops are fixed at the position where the ink drops are placed by the nozzle on the UV curable primer.

A method according to an embodiment of the present disclosure may further comprise controlling bleeding of said ink, preferably in a variable way. By controlling the bleeding of the ink in variable way is meant that bleeding may be both reduced, increased and/or maintained as caused by the surface on which the ink is applied to. Controlling bleeding of the ink may be performed in several ways, as described below. An advantage of controlling bleeding of the ink is that the bleeding may be adjusted to obtain a certain design of the decorative pattern, for example with sharp contours or with blurred contours. Thereby, a specific design can be reproduced with high accuracy.

A way of controlling the bleeding is to control the size of the droplets of ink applied. By applying small droplets of ink to the surface, the droplets will dry before starting to bleed into each other. Thereby, bleeding is reduced. By applying the droplets at a sufficient distance from each other such that the droplets do not flow into each other before drying, bleeding is also reduced. Also the surface tension of the small droplets of ink contributes to reduced bleeding.

Instead, by applying larger droplets of ink to the surface, the droplets of ink will flow into each other. Thereby, bleeding of the ink is increased. Furthermore, by applying droplets of ink close to each other such that the droplets will flow into each other before drying, bleeding of the ink is also increased. Other ways of controlling the bleeding of ink is described below.

The surface tension of the ink will influence the tendency to bleed. The viscosity of the ink will influence bleeding as well. A preferred embodiment of the aqueous ink in order to have controllable bleeding is a viscosity of 10-15 mPas at jetting temperature of 30° C. A preferred surface tension of the aqueous ink is 30-40 mN/m in order to have controllable bleeding. A preferred pH-value of the aqueous ink is 7-8. A preferred particle size of the pigments is less than 500 nm, preferably 80-300 nm.

The wood-based material may be solid wood or wood veneer. By solid wood is also meant hardwood. The wood-based material may also be MDF, HDF, or particleboard. By wood-based material is not meant paper. Paper essentially comprises highly refined α-cellulose fibres.

The digital printing device may comprise a Drop-on-Demand (DOD) inkjet printer, preferably a piezoelectric DOD inkjet printer. By using the DOD technique, drops of inks can be placed on the surface with great accuracy. Thereby, a decorative design can be repeated with accuracy and a design with high resolution can be printed.

The aqueous ink may be a heat sensitive curing ink. A heat sensitive curing ink cures when being exposed to heat. Curing the ink prevents the ink from bleeding into the surface. When applying ink to a surface of wood-based material, the ink has a tendency to bleed into the wood. The wood includes capillaries transporting the ink from the surface into the interior of the wood. Furthermore, bleeding of the ink may result in that the design blurs. When curing the ink, further bleeding of the ink is stopped and the ink is "dried".

A method according to an embodiment of the present disclosure may further comprise applying heat to the element. By applying heat, water in the aqueous ink evaporates and the ink dries. Thereby, bleeding of the ink is reduced. If the aqueous ink is a heat sensitive curing ink, heat starts the curing reaction of the ink and curing of the binder prevents bleeding. Heat may be applied before, during and/or after printing. If heat is applied to the surface before printing, the element will be heated when the ink is applied. Thereby, drying of the ink starts immediately. If using a heat sensitive curing ink, curing takes starts immediately when heat is applied before printing.

A method according to an embodiment of the present disclosure may further comprise applying a primer adapted to control the ink on at least a portion of said surface. The primer may be applied prior to or after printing the decorative design. The primer interacts with the ink such that the primer controls the ink in one way or the other. The primer may for example restrict bleeding of the ink, or may increase bleeding of the ink. The primer may be applied to a portion or several separate portions of the surface, or may cover the entire surface.

The primer may be an ink fixing primer. By ink fixing is meant that the primer fixes the ink such that bleeding of the ink is prevented. An ink fixing primer restricts conveyance of the ink in the capillaries of the wood. Thereby, the ink is restricted from being transported away from the surface and from bleeding outside the boundaries of the pattern.

The primer may agglomerate said ink. When the primer agglomerates the ink, the primer fixes the ink and prevents bleeding of the ink. The ink and the primer form an agglomerate when reacting with each other.

In an alternative embodiment, the primer may be an ink spreading primer. The primer spreads the inks such that the binder increases bleeding of the ink. An example of an ink spreading primer is water.

The primer may be applied by means of digital printing. By applying the primer by a digital printing device, the primer can be applied to the surface with high precision. Thereby, the primer may be applied to only some portions of the surface.

Further, one or more primers having different properties can be applied to different portions of the surface with high precision, thereby offering a possibility to control the design of the pattern. It may be desirable to apply an ink fixing primer to a first portion of the surface, to apply an ink spreading primer to a second portion of the surface, and to not apply any primer to a third portion of the surface. Thereby, bleeding of the ink is controlled in different ways at different portions and the design of the pattern can be varied between different elements of the pattern. When printing a natural wood pattern or stone pattern, this effect may be desirable. This aspect of the disclosure may be used also with other types of ink than aqueous inks. This aspect of the disclosure may also be used on other types of elements than an element of a wood-based material.

A method according to an embodiment of the present disclosure may further comprise applying a protective surface layer on top of the decorative pattern. The protective surface layer may include wear resistant particles. The protective surface layer may be one or several lacquer layers, a powder layer comprising wood fibres and a binder or any other type of conventional protective surface. The protective surface layer may be a radiation curable coating, preferably a UV curable coating. The protective surface layer may be a coating comprising an acrylic or acrylate binder.

The ink may comprise pigments. Thereby, a pigmented aqueous ink is used.

The digital printing device may use spot colours or CMYK colours. Spot colours may be preferred when printing patterns of natural wood or stone since spot colours allow usage of a more natural range of colours compared to CMYK.

The ink may comprise a binder. By applying heat to the ink, the binder cures and further bleeding of the ink is reduced.

The element may form a surface layer of a building panel. The building panel may be a flooring panel. In the embodiment wherein the building panel is flooring panel, a method according to an embodiment of the present disclosure may further comprise forming a mechanical locking system at least at one edge of the flooring panel.

According to a second aspect of certain embodiments of the present disclosure, a building panel is provided, comprising an element of a wood-based material forming a surface of said building panel, said surface being solid and being formed of said wood-based material, said surface having a decorative design printed thereon, said decorative design being formed of an aqueous ink, and preferably a primer comprising at least one metallic salt.

The aqueous ink may comprise pigments. The aqueous ink may be a heat sensitive curing binder. The decorative design may be printed on top of a primer arranged on the surface. The second aspect of certain embodiments of the present disclosure may incorporates one, some or all the advantages of a method according to the first aspect of embodiments of the present disclosure, which previously has been discussed, whereby the previous discussion is applicable also for the building panel.

BRIEF DESCRIPTION OF THE DRAWINGS

The present disclosure will by way of example be described in more detail with reference to the appended schematic drawings, which show embodiments of the present invention.

DETAILED DESCRIPTION

Figure 1:
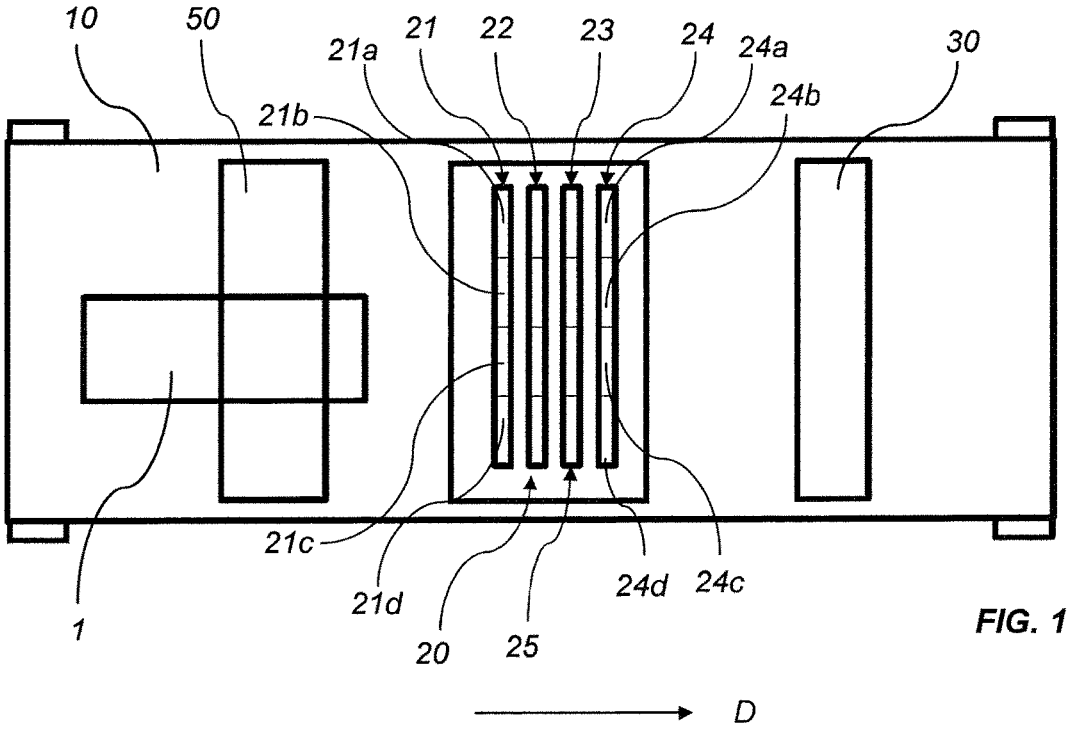
FIG. 1 illustrates a printing line comprising a digital printing device and a primer application device.

FIG. 1 shows a printing line including a digital printing device 20 to be used in a method according to an embodiment. The printing line comprises a conveyor belt 10, a primer applying unit 50 adapted to apply a primer, a digital printing device 20 and a heating device 30.

The printing line is adapted to form a decorative design on an element 1 of a wood-based material. The element 1 has a surface 3 of a wood-based material. The wood-based material may be solid wood or wood veneer. The wood-based material may also be a wood fibre based material such as MDF, HDF and particleboard. The surface 3 is a solid surface. The surface 3 may be a rigid surface. The element 1 may for example be a layer, for example a wood veneer layer, having a thickness of 0.6 mm or even 0.3 mm, for example, in the range of 0.3 to 0.6 mm.

The element 1 may already be attached to a core or substrate when the decorative design 2 is printed on the element 1. Alternatively, the decorative design 2 is printed on the element 1 before the element 1 is attached any core or substrate. The element 1 having the decorative design 2 printed thereon is thereafter attached to a core or substrate. The element 1 being attached to a core or substrate may form a building panel. Alternatively, the element 1 itself may form a building panel. The building panel may be a floor panel, a wall panel, a ceiling panel, a furniture component or the like. The building panel may for example be a solid panel, a panel comprising several layers, or a panel comprising a core and said element being arranged as a surface layer on the core.

The decorative design 2 that is to be printed on the element 1 may be both natural designs and patterns such as a wood pattern or stone pattern. The decorative design may also be a fantasy design or pattern.

The element 1 is placed on the conveyor belt 10. The conveyor belt 10 is adapted to convey the element 1 on which the decorative print 2 is to be printed in a conveying direction D. The element 1 is conveyed to the primer applying unit 50, to the digital printing device 20 and to the heating device 30.

The primer applying unit 50 is adapted to apply a primer adapted to control the ink. By controlling the ink is meant controlling the behaviour of the ink such as bleeding. The ink is an aqueous ink, preferably a heat sensitive curing ink.

The primer applying unit 50 applies the primer on the surface 3 of the wood-based material of the element 1. The primer applied before the decorative design may be printed on the surface of the element 1. The primer applying unit 50 may spray the primer on the surface 3 of the element 1. The primer applying unit 50 may alternatively coat the surface 3 of the element 1 with the primer.

As an alternative, the primer applying unit 50 may comprise a digital printing device such that the primer is applied by digital printing technique. The digital printing device may be a DOD printer, preferably a DOD piezoelectric printer. By using a DOD printer, the primer can be applied with great accuracy. For example, the primer can be applied to well-defined portions of the surface 3 of the element 1.

The primer may in one embodiment be an ink fixing primer. By ink fixing is meant that the primer fixes the ink such that bleeding of the ink is reduced. The ink fixing primer restricts conveyance of the ink in the capillaries of solid wood such that the ink becomes fixed. Thereby, bleeding of the ink into the wood-based material is reduced. Also bleeding outside the boundaries of the individual elements forming the pattern is reduced by application of the ink fixing primer.

The primer may agglomerate said ink. When the primer agglomerates said ink, the primer fixes the ink and prevents bleeding of the ink. When the primer reacts with the ink, the ink and the primer form an agglomerate. By forming an agglomerate, the primer fixes the ink such that bleeding is reduced. The ink is thereby restricted from bleeding by being in form of an agglomerate on the surface of the element.

The primer may comprise at least one metallic salt such as sodium chloride. The primer may be an aqueous solution comprising at least one metallic salt. The metallic salt may be a monovalent metallic salt, for example comprising a monovalent ion such as $Na^+$. The metallic salt is preferably a polyvalent metallic salt. Preferably, the polyvalent metallic salt comprises divalent ions such as $Ca^{2+}$, $Cu^{2+}$, $Ni^{2+}$, $Mg^{2+}$, $Zn^{2+}$, or $Ba^{2+}$, or trivalent ions such as $Al^{3+}$ or $Fe^{3+}$. The metallic salt may for example be sodium chloride or calcium chloride. The metallic salt precipitates the pigment of the ink. The metallic salt reacts with the aqueous ink such that the pigment of the ink precipitates. The metallic salt of the primer crashes the ink such that the pigment of the ink precipitates or agglomerates. By crashing the aqueous pigment ink composition, the ink drops are fixed at the position on the carrier where the ink drops are placed by the nozzle. By crashing the aqueous pigment ink composition, the ink drops are prevented from being mixed with each other, or at least result in reduced mixing. By varying the concentration of the metallic salt in the primer, the bleeding of the ink may be controlled. By increasing the concentration of the metallic salt in the primer, bleeding is further reduced.

The primer may in one embodiment be a UV curable primer. The UV curable primer functions as an ink fixing primer reducing bleeding of the aqueous ink. The UV curable primer is applied before the print forming the decorative pattern is applied. The UV curable printer is not cured, or is not completely cured before the decorative design is printed. The print may be printed wet-on-wet on the UV curable primer. As an alternative, the UV curable primer may be gelled. The aqueous ink is printed directly into the UV curable primer. It is not necessary to apply any intermediate layer. The UV curable primer fixes the ink such that bleeding into the wood-based surface and outside the boundaries of elements forming the pattern is reduced.

The UV curable primer may also be adapted to form a primer for any UV curable coatings forming a protective surface layer. The UV curable primer may be compatible with a UV curable coating forming the protective surface layer applied after printing.

As an alternative or complement, the primer may be an ink spreading primer. By ink spreading is meant that the primer spreads the inks such that the primer increases bleeding of the ink over the area where the primer is applied. Thereby, a blurred pattern can be obtained. An example of an ink spreading primer is water. By applying water prior or after printing, bleeding of the ink is further increased.

The primer may be applied to the complete surface 3 of the element 1, or only to portions of the surface of the element 1. Different types of primers may also be applied to the surface 3. As an example, an ink fixing primer may be applied to a first portion of the surface 3, an ink spreading primer may be applied to a second portion of the surface 3 and no primer may be applied to a third portion of the surface 3. Thereby, the design of the decorative pattern 2 can be controlled by applying different types of primers to different areas of the element 1.

After the primer has been applied, the decorative design 2 is printed on the surface 3 by the digital printing device 20.

The digital printing device 20 is a Drop-on-Demand (DOD) inkjet printer. Preferably, the printer 20 is a piezoelectric DOD inkjet printer. A thermal DOD inkjet printer may also be used.

The digital printing device 20 comprises at least one inkjet print head 25. Preferably, the digital printing device 20 comprises several inkjet print heads 25. If CMYK is used as a colour system, at least four inkjet print heads 25 is required, one for every colour. If spot colours are used, one print head 25 is required for each spot colour. The number of spot colours and thereby the number of print heads 25 may vary. The digital printing device 20 shown in FIG. 1 comprises four print heads 25, corresponding to CMYK-colours or four spot colours.

Preferably, a number of print heads 25 are arranged one after in a row extending perpendicular to the conveying direction of the conveying belt. Print heads arranged in the same row includes ink having the same colour. The width of the row of print heads preferably corresponds to the width of the element 1 on which the print 2 is to be applied.

In the shown digital printing device 20, a first, second, third and fourth row 21, 22, 23, 24 of print heads are arranged one after each other in the conveying direction D of the conveyor belt 10. A first colour is applied by the print heads 21*a-d* in the first row 21, a second colour is applied by the print heads 22*a-d* in the second row 22, a third colour is applied by the print heads 23*a-d* in the third row 23 and a fourth colour is applied by the print heads 24*a-d* in the fourth row 24.

Alternatively, a digital printing device comprising a print head having different channels may be used. In this case, one print head may print one colour or several colours. Thereby, more than one colour can be printed by an individual print head provided with different channels. One channel is provided for each colour. Consequently, only one row of print heads may be provided in the digital printing device.

The ink that is applied by means of the above described inkjet print 20 is an aqueous ink. The ink comprises pigments giving the ink its specific colour. Preferably, the aqueous ink is a heat sensitive curing ink. The ink may comprise a binder. The binder may for example comprise methyl acrylate, ethyl acrylate, butyl acrylate, or vinyl acetate.

The digital printing device 20 is used to print a decorative design 2 on an element 1.

The conveyor belt 10 moves the element 1 through the digital printing device 20. The print heads 25 are preferably stationary while the element 1 is transferred in the conveying direction D under the print heads 25. The first row 21 of print heads 21*a-c* prints a first colour on the surface 3, the second row 22 of print heads 22*a-c* prints a second colour on the surface 3, a third row 23 of print heads 23*a-c* prints a third colour on the surface 3, and a fourth row 24 of print heads 24*a-c* prints a fourth colour on the surface 3.

After the digital printing device 20, as seen in the conveying direction D of the conveyor belt 10, a heating device 30 is arranged. The heating device 30 may include infrared (IR) heating. Consequently, when the element 1 has passed the digital printing device 20, heat is applied to the element 1 by means of the heating device 30. The heating device 30 dries the aqueous ink since water evaporates from the ink. Consequently, heating the element 1 with the print applied thereon prevents further bleeding of the aqueous ink and stabilises the print. If an ink sensitive curing ink is used, heat cures the ink and stabilises the ink thereby.

In FIG. 1, the heating device 30 is arranged after the digital printing device 20. Alternatively or as a complement, the heating device 30 may be arranged in front of the digital printing device as seen in the conveying direction D. When heat is applied to the element 1 before being inserted in the digital printing device 20, the element 1 is already heated when ink is applied to its surface 3. Thereby, the inks dry and/or cures, if a heat sensitive curing ink is used, faster compared to printing on an unheated element 1. Thereby, bleeding is reduced.

Heat may also be applied to the element 1 in the digital printing device 20. In this case, a first colour is printed on the element 1, and heat is then applied to the element 1 before printing the second colour. Thereby, the ink of the first colour dries, and if a heat sensitive curing ink is used, the ink cures when heat is applied. Bleeding is thereby reduced. Especially, bleeding of two different colours into each other may be reduced.

Figure 2:
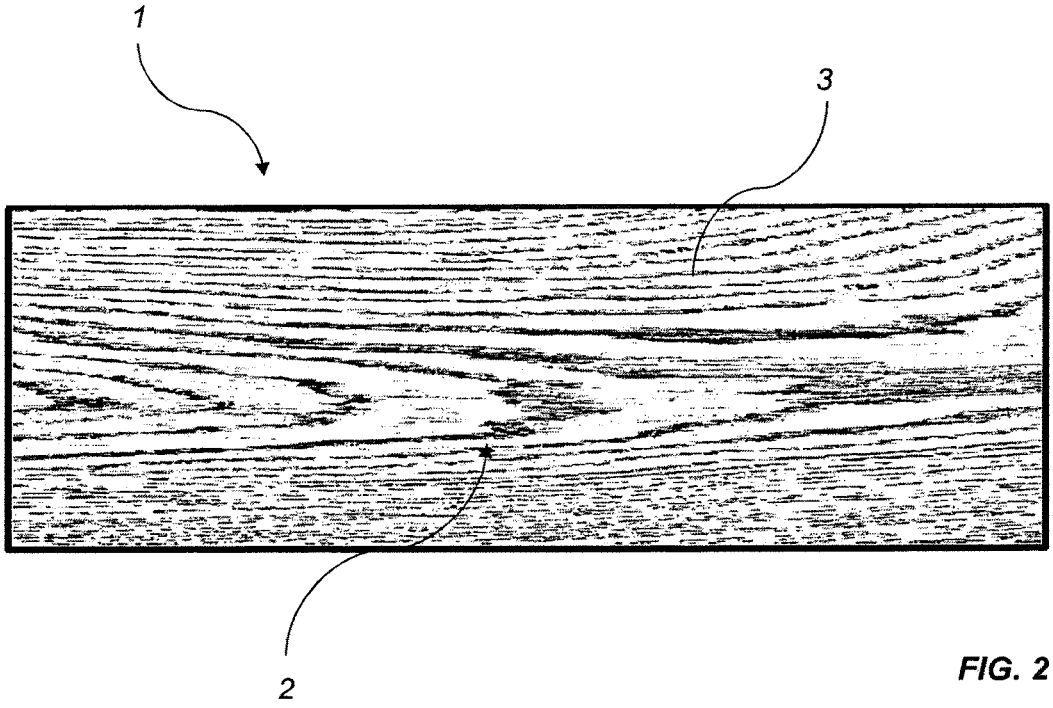
FIG. 2 illustrates an element having a decorative wood design printed thereon.

FIG. 2 illustrates an element 1 having a print forming the decorative design 2 printed by means of the above described method. The decorative design 2 is a natural wood pattern. The wood pattern is printed on an element 1 having a surface 3 of solid wood material or wood veneer. The solid wood material or wood veneer may for example be hickory, birch wood or beech wood. The wood pattern resembles natural wood.

When applying an aqueous ink directly on a surface 3 of wood-based material, the ink bleeds into the wood-based material. In a solid wood material and in veneer, the ink is conveyed by the capillaries in the wood-based material. This may lead to that the boundaries of the pattern blur. However, when printing a natural wood pattern, bleeding may be desirable, at least at some portions of the element 1, since it creates a soft and natural pattern, as seen in FIG. 2. The bleeding occurring due to the aqueous ink being conveyed by the capillaries may create design advantages when forming the decorative design, especially when printing a natural wood pattern.

Figure 3:
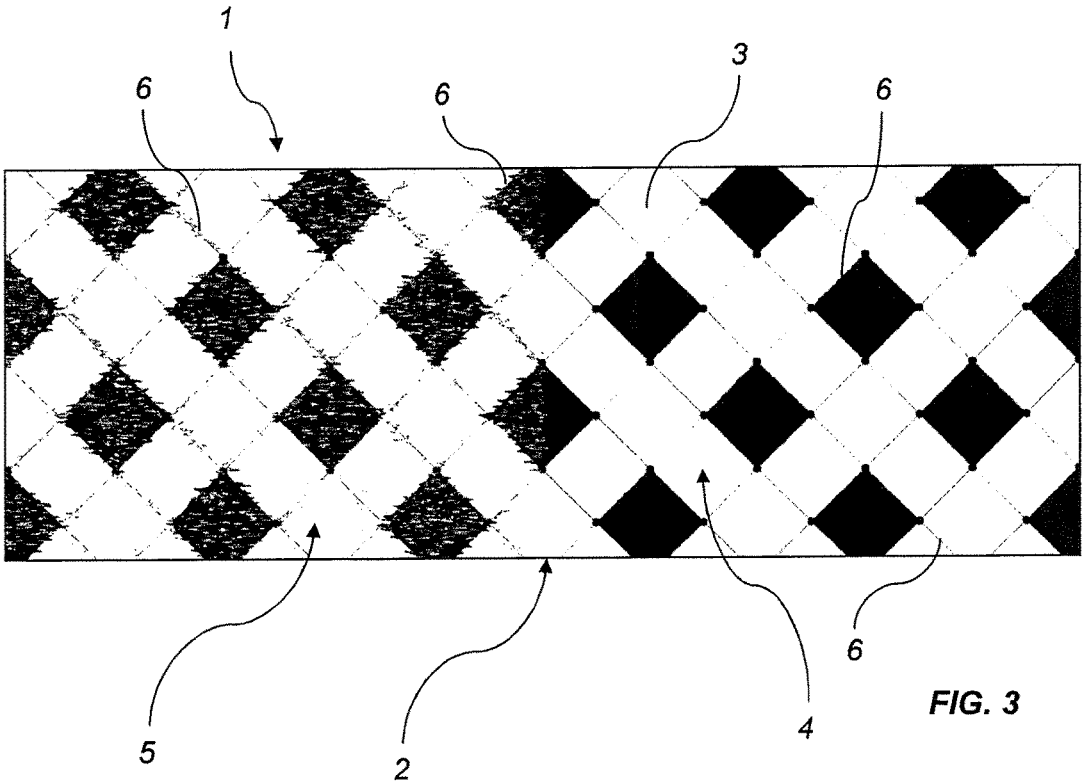
FIG. 3 illustrates an element having a fantasy design pattern printed thereon.

FIG. 3 illustrates an element 1 wherein an ink fixing primer has been applied to a first portion 4 of the surface 3 of the element 1 as described above. No primer has been applied to a second portion 5 of the surface 3 of the element 1. A fantasy pattern 2 has been printed on the surface 3 of wood-based material by means of the digital printing device 20. The ink is aqueous ink.

FIG. 3 illustrates the difference in bleeding of the ink between the first portion 4 where the ink fixing primer is applied and the second portion 5 where no primer has been applied. On the second portion 5, the boundaries 6 between different colours and between parts where no ink has been applied and parts where ink has been applied are blurred. The reason for this is that the ink bleeds outside the area where ink has been applied in a direction parallel to the plane of the surface 3. Before the ink has dried, or cured if using a heat sensitive curing ink, the ink continues to flow outside the area to which it is applied. In solid wood and in veneer, the capillaries in the wood convey the ink. This may lead to that ink bleeds outside the area to which is applied. If two colours are applied one besides the other, the colours may bleed into each other such that no distinct boundary is obtained. If one colour is applied adjacent an area where no ink is applied, the ink may bleed into the area with no colour and no distinct boundary is obtained.

Furthermore, in addition to bleeding in a direction parallel to the plane of the surface, the ink may also bleed into the wood-based material of the surface 3, i.e. in a direction perpendicular to the plane of the surface 3. The ink is transported into the wood-based material, away from the surface. In solid wood and in veneer, the capillaries in the wood convey the ink into the interior of the wood-based material. This may result in that the surface is not covered by the colour but the wood shows through. An uneven covering of the colour may thereby be obtained.

In FIG. 3, on the first portion 4 where the ink fixing primer has been applied the boundaries 6 between adjacent colours and boundaries 6 between a coloured portion and a portion where no ink has been applied are distinct. Further, the wood-based material does not show through the coloured portions due to reduced bleeding into the wood-based material. The ink fixing primer has reduced bleeding of the ink such that the ink has been fixed on the position where it has been placed by the inkjet print head.

Figure 4:
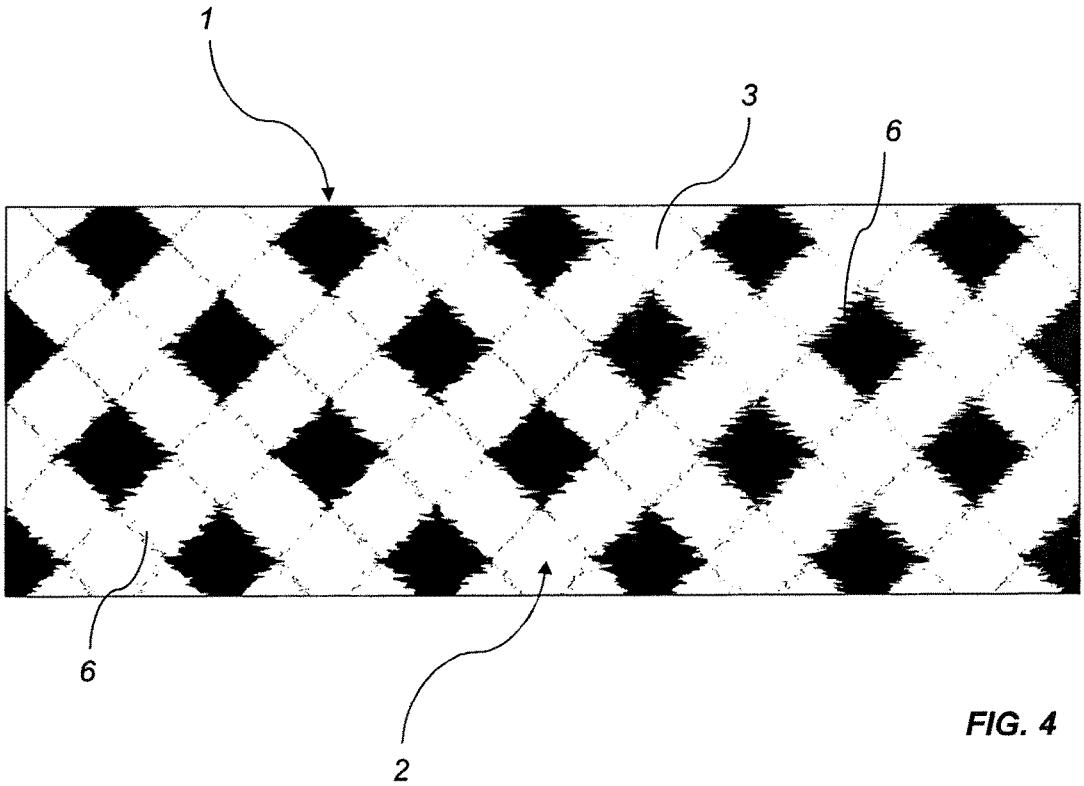
FIG. 4 illustrates an element having a fantasy design pattern printed thereon.

FIG. 4 illustrates an element 1 wherein an ink spreading primer has been applied to the surface 2 of the element 1 as described above. The ink spreading primer has increased the bleeding of the ink applied to the area where the ink spreading primer has been applied. Thereby, a blurred design is obtained. Some of the ink has been transported into the interior of the wood-based material such that the surface of the wood-based material shows through.

Figure 5:
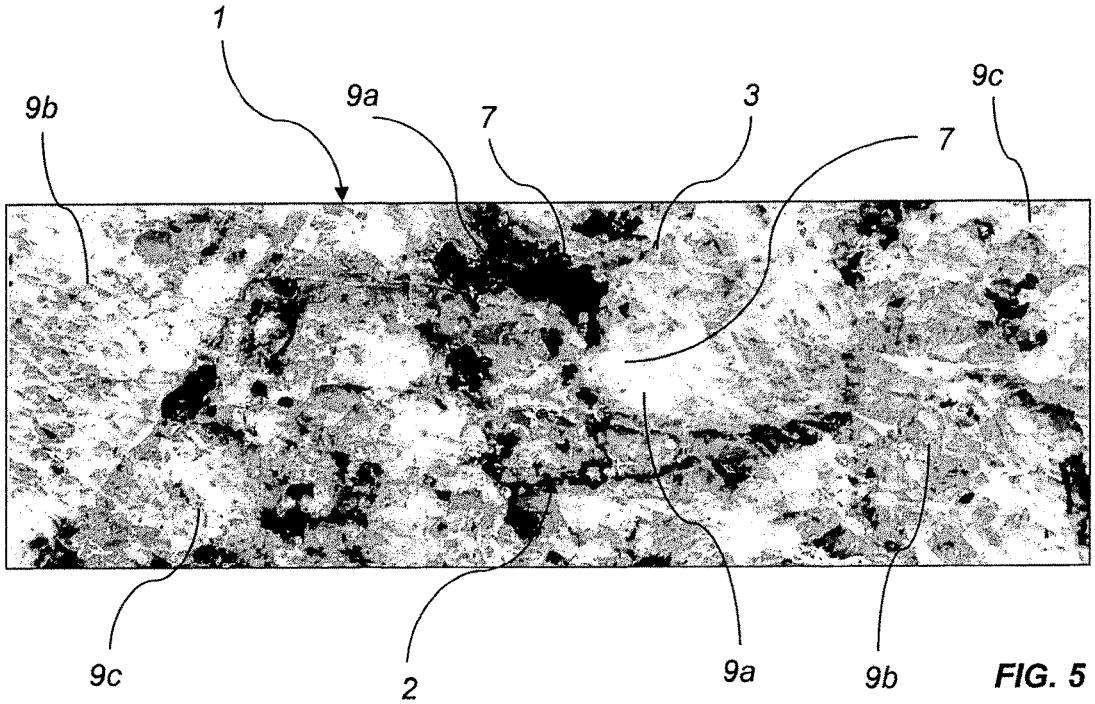
FIG. 5 illustrates an element having a stone design pattern printed thereon.

FIG. 5 illustrates an element 1 having a stone pattern printed thereon. Primers having different properties have been applied on the surface 3 of the wood-based material. A decorative design 2 in form of a stone pattern has been printed on the surface 3 by means of the digital printing device 20 as described above.

The stone pattern includes both element having sharp contours 7 and elements having blurred contours. In order to recreate the natural stone pattern, an ink fixing primer has been applied to some portions 9*a* of the surface 3. An ink spreading primer has been applied to other portions 9*b* of the surface 3. No primer is applied to other portions 9*c* of the surface 3. Thereby, the bleeding of the ink can be controlled in order to obtain different effects. Preferably, the primers are applied by digital printing such that the primers can be applied with high precision. By applying both the primers and the ink by a digital printing technique, the primers and the ink can be applied with high precision in relation to each other. A design being very similar to a natural stone pattern can be obtained this way. Applying different primers as described above is not restricted to the use of an aqueous ink and is not restricted to an element of a wood-based material but may be used also for other materials.

Common for all embodiments is that heat may also be applied to the element before and/or during printing the decorative design in the digital printing device, which has been described above.

Common for all embodiments is that a protective surface layer may be applied on top of the print. The protective surface layer may comprise wear resistant particles such as aluminium oxide or silica. The protective surface layer may be one or several lacquer layers. The lacquer layer may for example be a water-based UV curable lacquer, a polyurethane lacquer, a solvent based lacquer, a two-parts lacquer. Alternatively, the protective surface layer may be a powder overlay comprising a mix of wood particles and a binder, preferably a thermosetting binder, which is applied as a powder layer on top of the print. The powder layer is cured by applying heat and pressure such that a powder overlay is formed. Alternatively, the protective surface layer may be a paper overlay.

Figure 6:
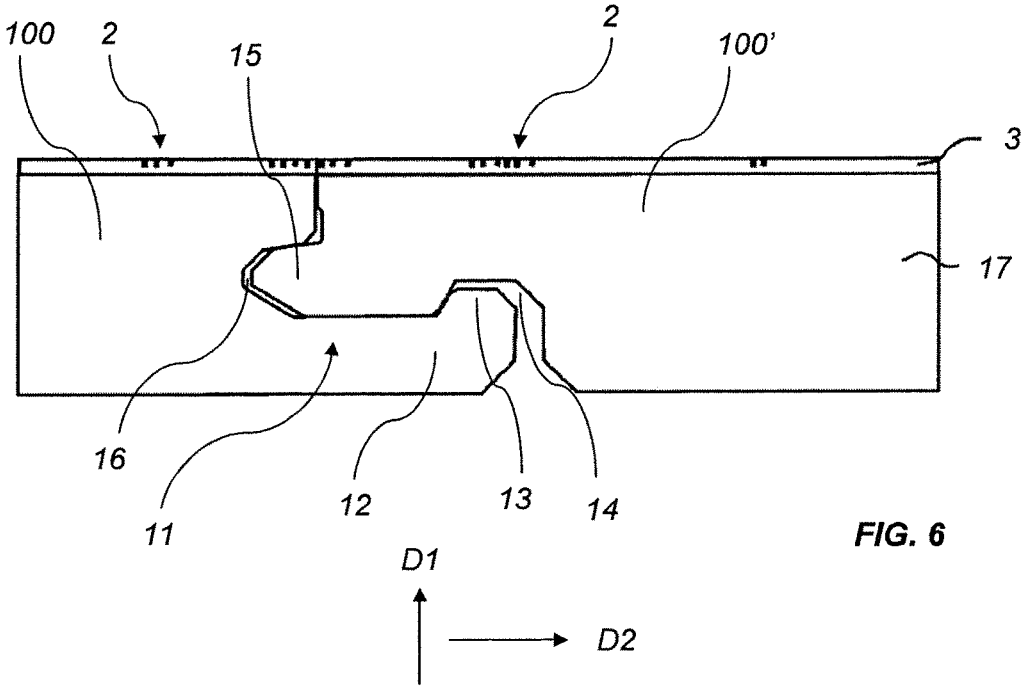
FIG. 6 illustrates building panels in form of flooring panels including a mechanical locking system.

FIG. 6 illustrates edge portions of two building panels in form of floor panels 100, 100'. The floor panel 100, 100' comprises in the embodiment shown in FIG. 6 a core 17 and said element 3 of wood-based material forming a surface of the floor panel 100, 100'. Said element 3 is attached to the core 17. A balancing layer (not shown) may be attached to the rear side of the core 17.

The floor panels 100, 100' comprise a mechanical locking system 11. The mechanical locking system 11 comprises a locking strip 12 with a locking element 13 that cooperates with a locking groove 14 and locks the panels 1, 1' in a horizontal direction D2. The mechanical locking system 11 further comprises a tongue 15 that cooperates with a tongue grove 16 and locks the panels 1, 1' in a vertical direction D1. Both long sides and short sides of the floor panel may be provided with a mechanical locking system 11. Alternatively, long sides of the floor panel may be provided with the mechanical locking system for horizontally and vertically locking, and the short sides may be provided with a mechanical locking system for horizontally locking only. It is also contemplated that other locking systems is possible.

It is contemplated that there are numerous modifications of the embodiments described herein, which are still within the scope of the invention as defined by the appended claims Although named as a primer, all primers described above may also be applied to the surface after printing of the decorative design. A primer applied after the print reacts with and controls the aqueous ink in a similar way as a primer applied to the surface before printing as described in more detail above.

EXAMPLE 1

An element of solid hickory is provided. No primer is applied to the surface of the element on which the decorative design is to be printed.

A decorative design is printed on a surface of said element by means of a digital printing device. The ink applied is an aqueous ink. The digital printing device comprises four print heads.

The decorative design is a natural wood pattern, which is printed on top of the wood pattern of the solid hickory.

No heat is applied prior, during or after printing.

After the ink has dried, at least one protective surface layer is applied to the surface of the element having the decorative design printed thereon. The lacquer used is a water-based polyurethane lacquer (Aqua Zar®, gloss 90 by M&P DIY Products AB).

An element having a decorative design as shown in FIG. 2 is thereby obtained. The bleeding of the aqueous ink contributes to obtain a natural wood pattern.

EXAMPLE 2

An element of solid oak is provided. An aqueous solution comprising at least one metallic salt is applied to a surface of the solid oak element. Depending on how much bleeding is desired, the concentration of the metallic salt in the aqueous solution is varied. The aqueous solution comprising the metallic salt forms an ink fixing primer. The aqueous solution is applied by means of a roller on the complete surface of the element.

A decorative design is printed on a surface of said element by means of a digital printing device. The ink applied is an aqueous ink. The ink is a heat sensitive curing ink. The digital printing device comprises four print heads.

The decorative design is a fantasy pattern.

Heat is applied after printing. The temperature is preferably 160-200° C., depending on the speed of the conveyor belt.

At least one protective surface layer is applied to the surface of the element having the decorative design printed thereon. The lacquer used is a water-based polyurethane lacquer (Aqua Zar®, gloss 90 by M&P DIY Products AB).

The ink fixing primer reduces the bleeding of the aqueous ink, thus forming sharp contours in the pattern.

EXAMPLE 3

An element of solid hickory is provided. A water-based UV-curable primer is applied to a surface of the element. The UV-curable primer is applied by means of a roller on the complete surface of the element. The UV-curable forms an ink fixing primer, reducing bleeding of the aqueous ink.

A decorative design is printed on a surface of said element by means of a digital printing device. The decorative design is printed wet-in-wet with the UV-curable primer, i.e. the UV-curable printer has not been cured. The ink applied is an aqueous ink. The ink is a heat sensitive curing ink. The digital printing device comprises four print heads.

The decorative design is a natural wood pattern resembling ash wood, which is printed on the hickory element.

The UV-curable primer is cured by a UV lamp.

When the UV-curable primer has cured, at least one protective surface layer is applied to the surface of the element having the decorative design printed thereon. The lacquer used is a water-based polyurethane lacquer (Aqua Zar®, gloss 90 by M&P DIY Products AB).

The UV-curable primer reduces bleeding of the aqueous ink.

EXAMPLE 4

An element of solid oak is provided. An aqueous solution comprising at least one metallic salt is applied to a first portion of the surface of the solid oak element. Depending on how much bleeding is desired, the content of the metallic salt in the aqueous solution is varied. The aqueous solution comprising the metallic salt forms an ink fixing primer. The aqueous solution is applied by means of a roller on the first portion of surface of the element.

No primer is applied to a second portion of the surface of the solid oak element.

A decorative design is printed on a surface of said element by means of a digital printing device. The ink applied is an aqueous ink. The digital printing device comprises four print heads.

The decorative design is a fantasy pattern.

At least one protective surface layer is applied to the surface of the element having the decorative design printed thereon when the print has dried. The lacquer used is a water-based polyurethane lacquer (Aqua Zar®, gloss 90 by M&P DIY Products AB).

An element having a decorative design as shown in FIG. 3 is thereby obtained. The ink fixing primer, which has been applied to the first portion of the surface, reduces the bleeding of the aqueous ink, thus forming sharp contours in the pattern. On the second portion of the surface, where no ink fixing primer has been applied, bleeding of the ink has occurred.

EXAMPLE 5

An element of solid hickory is provided. A water-based UV-curable primer is applied to a surface of the element. The UV-curable primer is applied by means of a roller on the complete surface of the element. The UV-curable forms an ink fixing primer, reducing bleeding of the aqueous ink.

A decorative design is printed on a surface of said element by means of a digital printing device. The decorative design is printed wet-in-wet with the UV-curable primer, i.e. the UV-curable printer has not been cured. The ink applied is an aqueous ink. The ink is a heat sensitive curing ink. The digital printing device comprises four print heads.

The decorative design is a natural wood pattern resembling ash wood, which is printed on the hickory element.

At least one protective surface layer is applied to the surface of the element having the decorative design printed thereon. The protective surface layer is an UV curable lacquer, or UV-curable lacquer layers.

The UV-curable primer and the UV-curable lacquer layer or layers are cured simultaneously by a UV lamp.

The UV-curable primer reduces bleeding of the aqueous ink.

The invention claimed is:

1. A method for forming a decorative design on an element of a wood-based material, the method comprising:

providing an element of a wood-based material having a surface, said surface being solid and being formed of said wood-based material;

applying a primer adapted to control bleeding of said ink on at least a portion of said surface, wherein the primer is a UV curable primer; and printing a decorative design with an aqueous ink on at least the portion of said surface by means of a digital printing device.

2. The method according to claim 1, wherein the wood-based material is solid wood or wood veneer.

3. The method according to claim 1, wherein the digital printing device comprises a Drop-on Demand (DOD) inkjet printer.

4. The method according to claim 1, wherein said aqueous ink is a heat sensitive curing ink.

5. The method according to claim 1, wherein the primer is applied by means of digital printing.

6. The method according to claim 1, further comprising applying a protective surface layer on top of the decorative design.

7. The method according to claim 6, wherein the protective surface layer comprises one or several lacquer layers of a UV curable lacquer or a polyurethane lacquer.

8. The method according to claim 1, wherein said element forms a surface layer of a building panel.

9. The method according to claim 1, wherein the primer comprises at least one monovalent metallic salt being $Na^+$.

* * * * *